US005626285A

United States Patent [19]

Tedford, Jr. et al.

[11] Patent Number: 5,626,285

[45] Date of Patent: May 6, 1997

[54] SIDESEAM JOINT FOR CARTON

[75] Inventors: Richard A. Tedford, Jr., Wallkill, N.Y.; Joseph Blackman, Durham, N.C.

[73] Assignee: International Paper Company, Purchase, N.Y.

[21] Appl. No.: 439,320

[22] Filed: May 11, 1995

[51] Int. Cl.[6] ..... B65D 5/06

[52] U.S. Cl. ..... 229/132; 229/198.2

[58] Field of Search ..... 229/132, 137, 229/138, 198.2

[56] References Cited

U.S. PATENT DOCUMENTS

| | | | |
|---|---|---|---|
| 2,461,251 | 2/1949 | Ball et al. | 229/137 X |
| 3,144,978 | 8/1964 | Asman . | |
| 3,229,890 | 1/1966 | Wright | 229/137 |
| 3,792,810 | 2/1974 | Tingley . | |
| 4,491,267 | 1/1985 | Tisma | 229/132 X |
| 4,588,122 | 5/1986 | Lisiecci | 229/137 |
| 4,657,177 | 4/1987 | Karabedian | 229/132 X |
| 4,989,780 | 2/1991 | Foote . | |
| 5,021,040 | 6/1991 | Phillips | 229/198.2 X |
| 5,056,707 | 10/1991 | Larsen | 229/137 X |

*Primary Examiner*—Allan N. Shoap
*Assistant Examiner*—Christopher J. McDonald
*Attorney, Agent, or Firm*—Michael J. Doyle

[57] ABSTRACT

An otherwise conventual paperboard blank for forming a gable top carton is provided with a cutout at a bottom corner of the first sidewall forming panel of a five panel blank. The bottom portions of the blank are conventionally folded to form a carton bottom end closure. The sideseam panel is tapered at one end due to a previous skiving operation. After localized heating of certain panel surfaces and upon folding the blank to initially form a tube, with the sideseam forming panel overlying an edge portion of the first panel (conventional procedures), the cutout coincides with the removed portion of the sideseam panel which forms the tapered end, to thus prevent unwanted adhesion between the first panel and the second panel.

4 Claims, 2 Drawing Sheets

SIDESEAM JOINT FOR CARTON

BACKGROUND OF THE INVENTION

This invention relates to paperboard containers of the type often used for the packaging of liquids such as milk and fruit juices. Such containers are fashioned from a unitary blank of paperboard, usually coated on both its interior and exterior forming surfaces with one or more barrier layer materials, cut and scored, erected and filled on automatic machinery to form gable top liquid packages. Such containers have a flat bottom and a gable top upper or roof section, the latter being adapted to form a pour spout when opened, all as known. An intermediate step in making such containers is the formation of a tube structure from the blank, with the steps of forming the end closures and filling with liquid taking place after tube formation.

In the formation of a gable top containers from a unitary blank having a plurality of wall forming panels serially arranged, one step involves forming a tube by folding the blank so that the fifth or sideseam forming panel is superposed over an edge zone of the free edge portion of the first sidewall forming panel. A part of the carton interior forming surface of the first panel has been heated so as to partially melt the usual polyethylene coating and make the latter sticky. Similarly, that portion of the fifth or sideseam panel which is to be in surface contact with the first panel free edge zone has also been heated so as to make its polyethylene coating sticky. The transverse cross sectional configuration of the now folded blank is substantially that of a shallow diamond, with a force applied to the upper two panels collapsing the diamond shaped tube, resulting in a force applied to the sideseam flap or panel to seal it to the edge zone portion of the first panel.

Often, the sideseam is skived, with the particular skiving process/apparatus employed unavoidably resulting in a taper at one end of the sideseam forming or fifth panel, at the bottom carton closure. This taper causes a partial triangular uncovering of the first panel edge zone, so that when the first and fourth panels are pushed downwardly to compress and seal the sideseam (fifth) panel against an edge zone of the second panel, a portion of the second panel will contact an exposed hot and sticky triangular portion of the first panel and cause an unwanted adhesion between a triangular portion of the first panel, near the tapered end of the sideseam panel, and the triangular portion of the second panel. In order to avoid this unwanted adhesion, the temperature of the heated first panel edge portion and the temperature of the fifth or sideseam forming panel was reduced to reduce the stickiness. While solving the problem of unwanted adhesion, such temperature reduction diminished the strength and quality of the seal between the sideseam panel and the first panel. This lowered quality becomes unacceptable with extended shelf life liquid cartons.

SUMMARY OF THE INVENTION

According to the practice of this invention, the noted unwanted adhesion between the second panel and the first panel attendant the formation of the sideseam joint is eliminated by providing the first panel with a cutout. That portion which is cut out corresponds in form to the triangular cutout or truncated portion at the tapered end of the sideseam forming fifth panel. In this way, when compression of the first panel against the sideseam panel and the first panel occurs, there is no hot and sticky exposed area of the first panel which will adhere to the second panel.

DETAILED DESCRIPTION OF THE INVENTION

Figure 1:
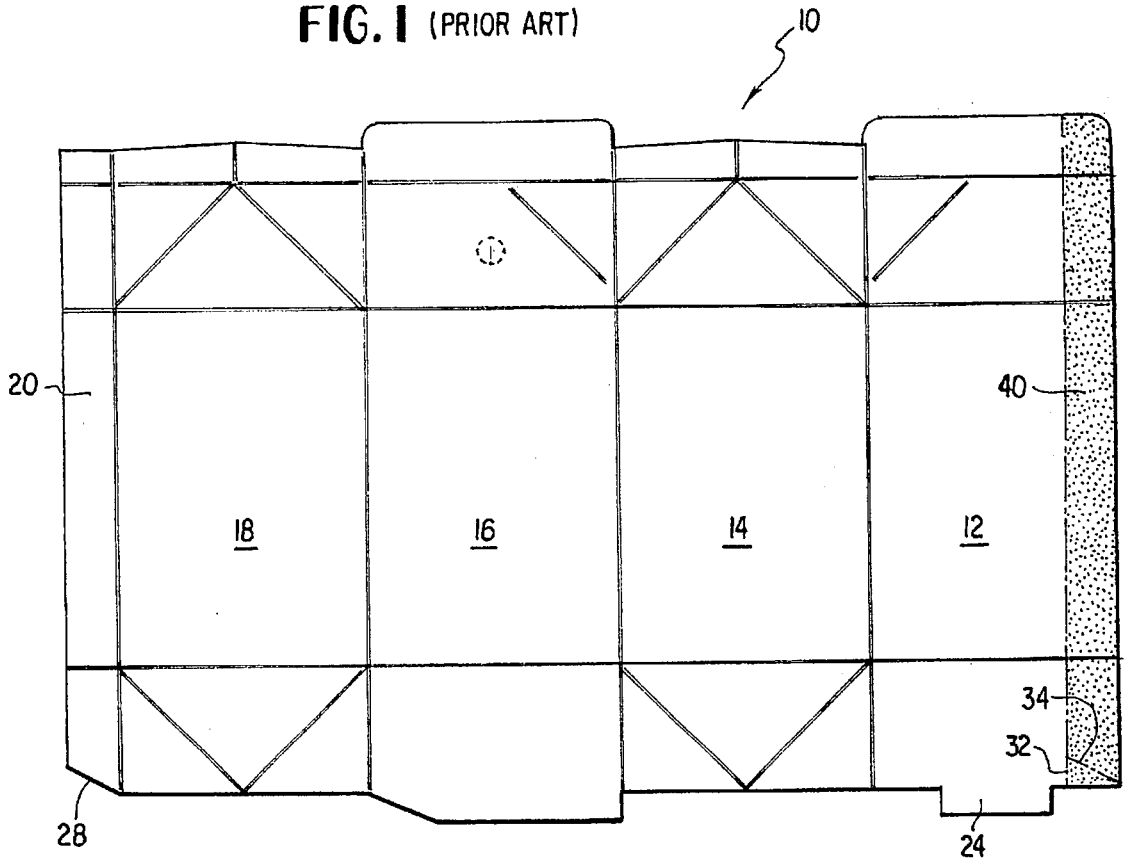
FIG. 1 (PRIOR ART)
FIG. 1 is a plan view of a prior unitary paperboard blank for forming a gable top liquid carton.
Figure 2:
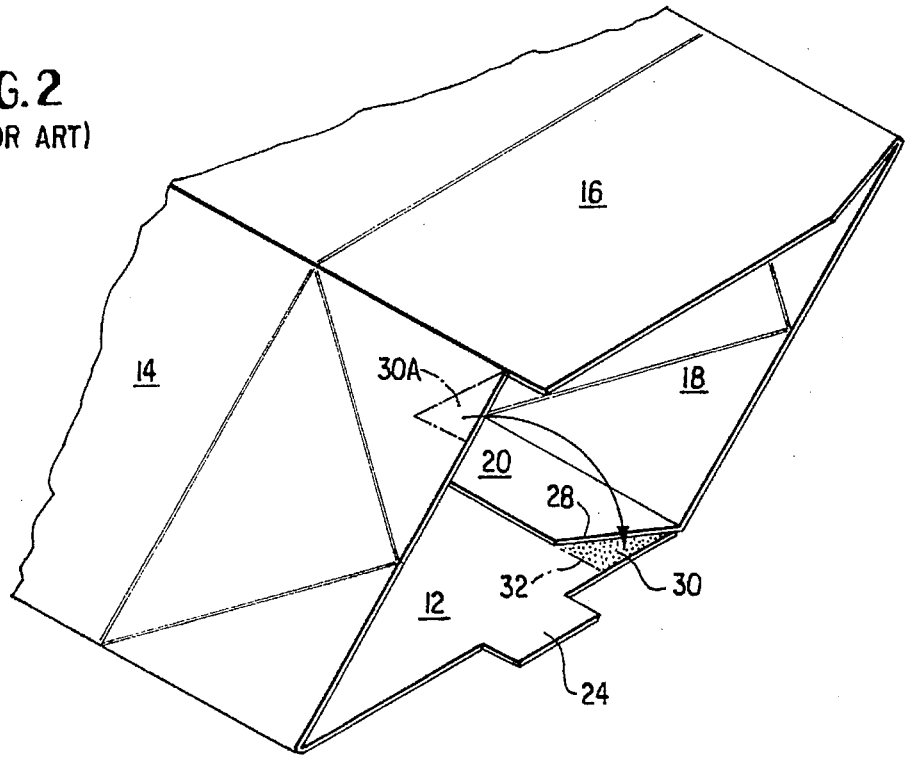
FIG. 2 (PRIOR ART)
FIG. 2 is a partial perspective view illustrating a typical prior art step in the formation of a seamed tube from a unitary bank cut and scored for producing a gable top container, and illustrates how unwanted adhesion occurs. For purposes of illustration and explanation, the second and third sidewall panels are shown in a position above the first and fourth sidewall panels. In practice, these relative positions are reversed, with panels 16 and 14 nearly coplanar.

Referring now to FIG. 1, a unitary paperboard 10 includes first, second, third, and fourth sidewall forming panels and a fifth, sideseam forming panel. These panels are denoted as 12, 14, 16, 18, and 20 respectively. The upper ends form a gable top when folded and erected, while the lower ends of the panels form a bottom closure. Tab 24 is conventional, and taper 28 is formed during the left or free edge skiving of fifth or sideseam forming panel 20. An imaginary triangular zone, later to be described, is bounded by imaginary lines 32 and 34. Right edge zone 40 of first panel 12 denotes a sealing area, later to be described. Both surfaces of the blank are provided with barrier layer coatings, including polyethylene, as is convectional. FIG. 2 illustrates a step in the formation of a tube from paperboard blank 10 for forming a gable top container. The paperboard blank is folded to form a tube having a longitudinal axis (the latter not shown) with sideseam panel 20 placed so as to overlap a part or zone 40 of the free edge of panel 12. Prior to this, the lower surface (as viewed at FIG. 2) of sideseam forming panel 20 has been heated, as by flame or other treatment, as has been that portion of panel 12 (see area 40 of FIG. 2) which will be in surface contact with sideseam panel 20. These two heated surfaces are at a higher temperature (not necessarily the same) than their respective surfaces on opposite sides of the blank. Second panel 14 and third panel 16 are now pressed downwardly, so that panel 14 presses the heated surface of sideseam forming panel 20 against the locally heated edge portion 40 of first panel 12. The thermoplastic on these portions of panels 20 and 12, because they have been heated, becomes tacky, with result that a joint or seam is formed between panels 12 and 18.

By virtue of taper 28 on sideseam forming panel 20, a triangular zone 30 is formed which is also heated with the rest of the free edge portion of panel 12. Accordingly, when panels 14 and 16 are pushed downwardly to apply pressure to form the sideseam joint or seam between panels 12 and 20, a corresponding portion 30A of second panel 14 becomes adhered to the hot and sticky triangular portion 30 of panel 12. This adhesion renders the tube unusable for further processing into a gable top carton. In the past, only lowering the surface thermoplastic (typically polyethylene) softening temperature of panels 12 and 20 eliminated the problem, but at the cost of an inferior sideseam joint.

Figure 3:
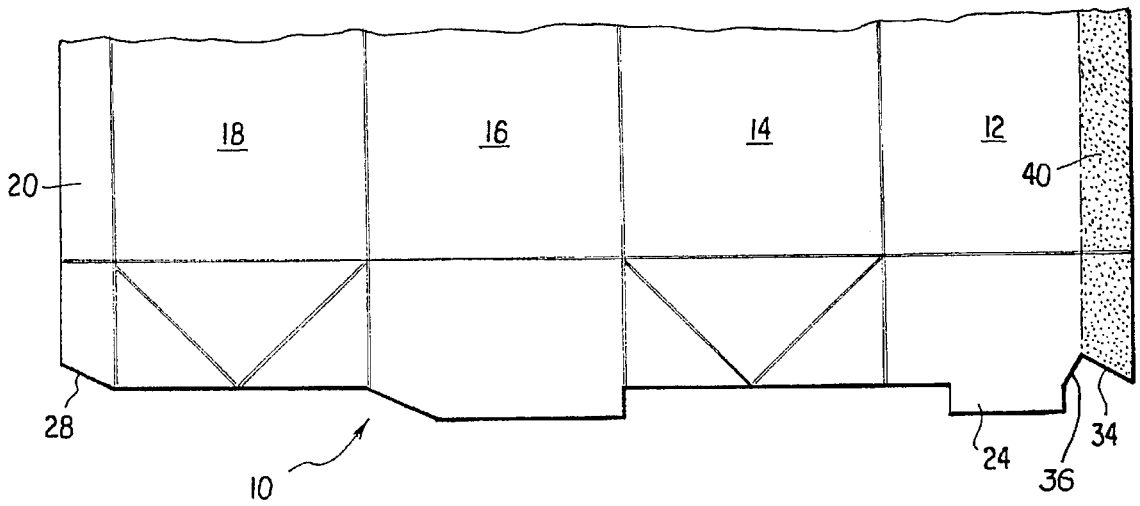
FIG. 3 is a plan view of a unitary blank of paperboard, otherwise conventional, which is provided with the cutout of this invention.

Referring now to FIG. 3, the blank of this invention is shown and differs from the blank of FIG. 1 only in the removal of a triangular zone bordered by cut lines 34 and 36.

Figure 4:
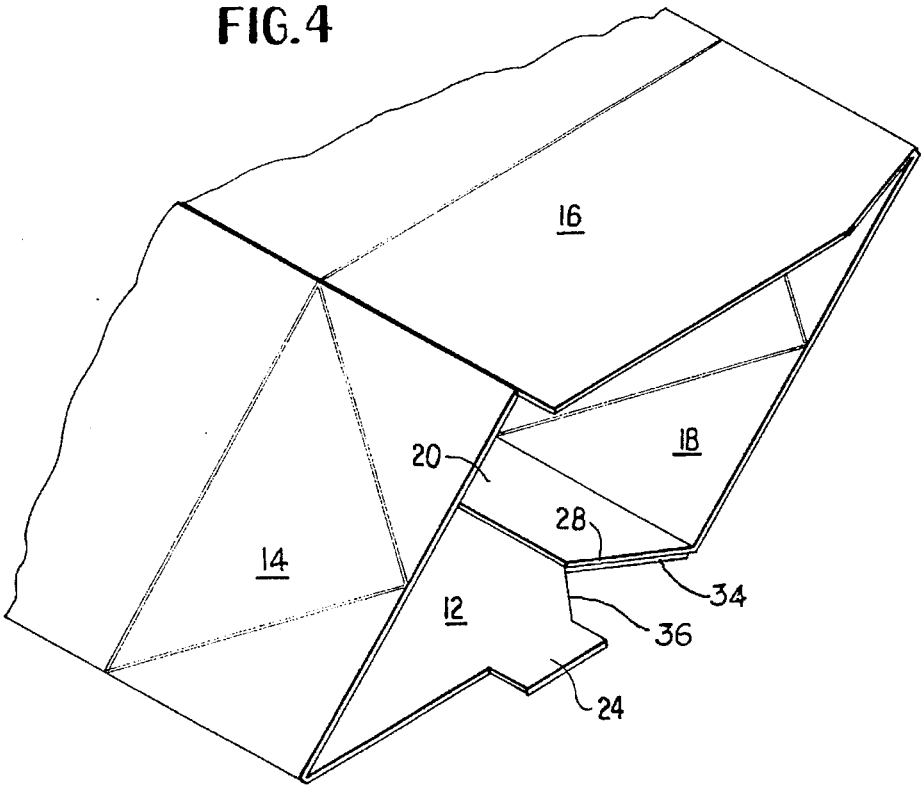
FIG. 4 is a view similar to FIG. 2, but with the blank of FIG. 3.

Referring now to FIG. 4, it is seen that when panels 14 and 16 are pressed downwardly to form the sideseam joint, there will be no zone or portion of panel 12 beyond taper 28 which will stick to panel 14 at region 30A. Thus, what is shown at FIG. 4 is conventional, except for cut lines 34 and 36 and the consequent absence of triangular zone 30 of FIG. 2. The cutout shown at FIGS. 3 and 4 is bordered by lines 34 and 36 and is triangular. FIG. 4 shows edges 28 and 34 as coincident. If desired however, cut line 36 could be curved or could extend straight downwardly, parallel to zone 40, instead of at an angle as shown at FIG. 3.

The practice of this invention greatly improves the integrity of the sideseam seal with first panel 12. Prior to the practice of this invention, the strength of the sideseam was about 0.3 KN/Meter and the average heating temperature of zone 40 and edge portion of panel 20 was 375 degrees K. This prevented the described unwanted adhesion. By virtue of this invention, the average heating temperature was increased to 385 degrees K. and the sideseam strength was increased to 0.9 MN/Meter. This increased strength makes possible the improved production of extended shelf life liquid packages.

As earlier stated, in practice the seam forming step shown at FIGS. 2 and 4 is carried out with the tube formed from the sidewalls and the fifth panel 20 rotated 180 degrees about its longitudinal axis.

We claim:

1. A unitary paperboard blank for forming a container, said blank including parallel fold lines to define serially joined first, second, third, fourth, and fifth container forming panels, said fifth panel adapted to overlap a free edge portion of said first panel to form an overlapped carton sideseam, each said panel having two ends, said fifth panel adapted to be sealed to a free edge portion of said first panel to form a tubular structure, said fifth panel being truncated at one end thereof, the improvement comprising, a cutout at an end of said free edge of said first panel, whereby when said fifth panel is overlapped and joined to said first panel free edge, said cutout of said first panel having a free edge that substantially coincides with said fifth panel truncated end.

2. The blank of claim 1 wherein said fifth panel truncated end is tapered and wherein said cutout is triangular.

3. A tubular structure formed from a paperboard blank having first, second, third, fourth, and fifth parallel panels foldably joined in series, a sideseam defined by overlapping said fifth panel onto a free edge portion of said first panel, said fifth panel having a taper at one end thereof by having a portion removed from said one end, the improvement comprising, an end of said free edge of said first panel having a cutout, said cutout having an edge substantially coinciding with said taper.

4. The tubular structure of claim 3 wherein said sideseam is formed by locally heating a thermoplastic which is coated on said overlapped portions of said first and fifth panels.

* * * * *